United States Patent [19]

McQueeny et al.

[11] Patent Number: 4,733,871

[45] Date of Patent: Mar. 29, 1988

[54] ITEM JUMPING GAME

[75] Inventors: Thomas P. McQueeny, Chicago; Wayne A. Kuna, River Forest, both of Ill.

[73] Assignee: Marvin Glass & Associates, Chicago, Ill.

[21] Appl. No.: 821,766

[22] Filed: Jan. 23, 1986

[51] Int. Cl.[4] ..... A63F 9/02

[52] U.S. Cl. ..... 273/399; 124/17; 273/291; 446/430

[58] Field of Search ..... 273/399, 19, 317, 410, 273/271, 255, 262; 446/429, 430; 124/16, 17

[56] References Cited

U.S. PATENT DOCUMENTS

| | | | |
|---|---|---|---|
| 680,175 | 8/1901 | Reinhart | 124/16 X |
| 1,402,637 | 1/1922 | Miller | 273/262 X |
| 3,305,236 | 2/1967 | Glass et al. | 273/255 X |
| 3,398,956 | 8/1968 | Lukes | 446/429 X |
| 4,243,227 | 1/1981 | Strongin | 273/399 X |

FOREIGN PATENT DOCUMENTS

| | | | |
|---|---|---|---|
| 2555459 | 5/1985 | France | 446/429 |

*Primary Examiner*—Paul E. Shapiro
*Attorney, Agent, or Firm*—John S. Pacocha

[57] ABSTRACT

A game in which players, in turn, lay down cards, or other distinguishable items, that are divided into two or more sets of two or more items each. The cards are laid down in lines with the goal of laying down an end card that matches the one at the other end of a line in order to qualify for a jump attempt. For the jump attempts, a biased, upwardly angled jump ramp is provided for placement at one end of the line of items to be jumped and a target landing ramp is supplied for the other end. If the jump is successful, the player collects all of the items jumped.

15 Claims, 8 Drawing Figures

ITEM JUMPING GAME

BACKGROUND OF THE INVENTION

1. Field of the Invention

This invention relates generally to games and more particularly to games that involve elements of luck, strategy and physical skill.

2. Background Art

There are numerous prior art games, including card games, involving both luck and strategy. In addition, there are games such as the well known, long time favorite "checkers", involving strategic movement of pieces upon a playing surface with the jumping of one or more pieces by a player upon occurrence of a prescribed arrangement. However, the jumping in such games does not require any particular physical skill while the determination of whether a player is entitled to make the jump depends primarily on strategy rather than the element of luck. Accordingly, there remains a need for a game that combines the elements of luck, strategy and skill while providing varying and entertaining play.

SUMMARY OF THE INVENTION

The present invention is concerned with providing a portable game for competitive play that involves the placement of items in lines upon a playing surface in order to qualify for attempting to jump over, and acquire, a line of the items. These and other objects and advantages of the invention are achieved by a game including a plurality of items divided into two or more sets of two or more items which are alignable upon a generally flat playing surface to form a line, an article capable of being launched from adjacent one end to beyond the other end of the line and a launcher for the article. To better define a successful launch or jump attempt, a target landing ramp is placeable at the other end of the line. The launcher includes an upwardly angled ramp with a carriage biased for movement atop the ramp from a position adjacent the player toward the upraised launch end. A board with a grid formed by raised ribs defines spaces for placement of the items, launcher and landing ramp. In order to facilitate the player securing the launcher in position in the absence of a raised rib board, a plate extends along the bottom of the launcher back toward the player so that the player can hold the launcher down with one end while pulling back the spring loaded carriage. In various alternatives, the items may be either cards with car indicia or actual toy vehicles with the article being either a card or a toy vehicle.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
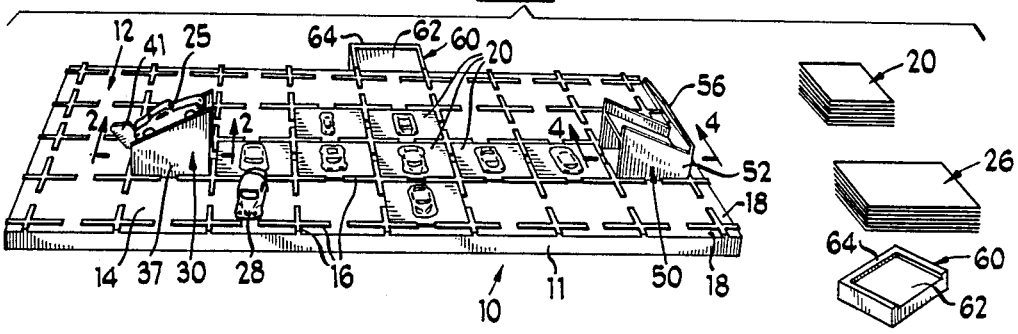
FIG. 1 is a perspective view of an embodiment of the present invention.

Referring now to the drawings in which like parts are designated by like reference characters throughout the several views, FIG. 1 shows a game 10 which includes a board 11 having a playing surface 12. As shown in the drawings, the board is rectangular, although, the game is not limited to a rectangular board. Upon playing surface 12 there is a grid of generally square spaces 14 partitioned by raised ribs 16. Around the periphery of playing surface 12 the intersecting raised ribs 16 form smaller, open sided rectangular spaces 18. The longer dimension of each of spaces 18 is substantially the same as that of the sides of square spaces 14 and the open side is one of the longer sides.

Items consisting of a stack of square cards 20 are divided into thirteen sets of four cards each. Each card 20 fits within spaces 14. The sets are distinguished by graphic car indicia 21 on one face which differ from set to set in both style and color of the car. Within each set the cards also bear a point value number 22 in one corner.

An article, different from the cards, such as a small scale, molded plastic or diecast, toy vehicle 25 is provided for jumping over a line of items on board 11. Alternatively, a jump card 26 can be used as the jumping article. Like item cards 20, jump cards 26 have a graphic car indicia 27 on one face. As yet another alternative, toy vehicles such as 28, which may be similar to vehicle 25, could be used as the items.

To propel the article over the line of items a launcher 30 is provided. Launcher 30 has a square bottom 31 that fits in a square space 14. A ramp 32 angles downwardly from an integrally formed front wall 33 toward an open-backed, player facing end 34. Generally centrally disposed lengthwise on ramp 32 is an open-ended slot 35 extending from back end 34 of launcher 30 up toward, but short of, front launch end 33. Less than half way in from the open end of slot 35 a stop 36 extends in from each side of the slot. Spaced apart sidewalls 37 extend up beyond ramp 32 and have inwardly extending rails 38 spaced above ramp 32.

Mounted for sliding movement between ramp 32 and rails 38 is a carriage 40 with a tab 41 projecting upwardly adjacent the rearward, or player facing, end of the carriage. On the underside of carriage 40, adjacent, but spaced in from the forward, or launch, end of the carriage is a projection 42 that extends transversely across the underside of the carriage. Projection 42 is long enough to fit inside of the width of slot 35 to guide the carriage for sliding movement along the top of the ramp. In addition to forward projection 42, the underside of carriage 40 has a rearward projection 44 of substantially the same length across the underside of the carriage as forward projection 42. Generally at the center of the length of rearward projection 44 is a hook 45. Inside of launcher 30, more particularly, in about the center of the upper inside corner formed by the bend between ramp 32 and front wall 33 there is a web 46 with a hook 47. Stretched between hook 45 and hook 47 is a rubber band 48 that biases carriage 40 up toward the launch end of ramp 32.

Figure 2:
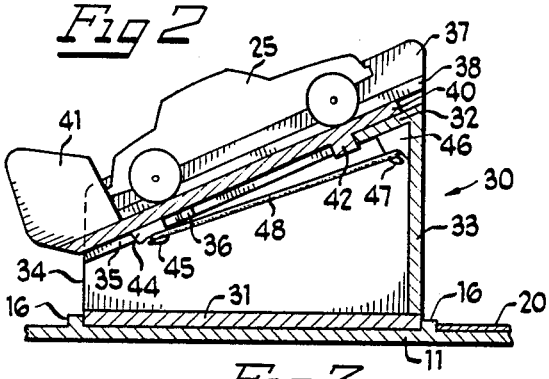
FIG. 2 is an enlarged scale, sectional view taken generally along line 2—2 of FIG. 1.
Figure 4:
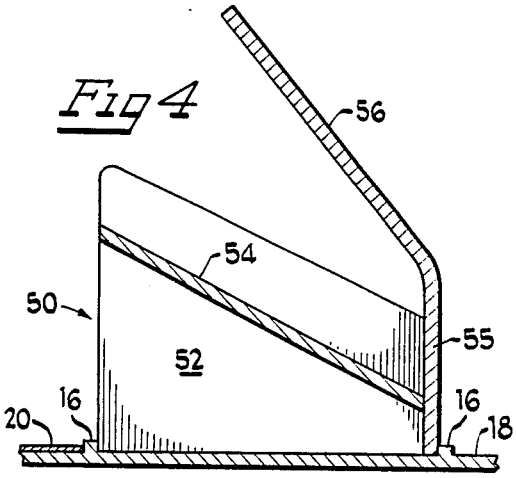
FIG. 4 is an enlarged scale, sectional view taken generally along line 4—4 of FIG. 1.
Figure 3:
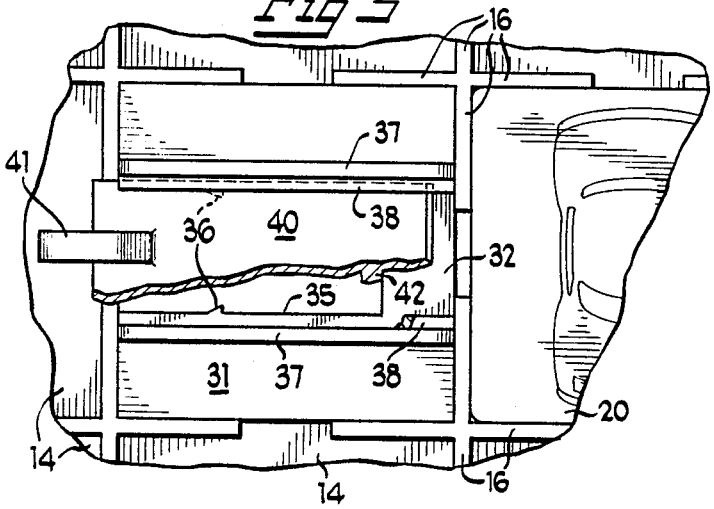
FIG. 3 is an enlarged scale, fragmentary top plan view, of the launcher with the article shown in FIGS. 1 and 2 removed and part of the carriage broken away.
Figure 5:
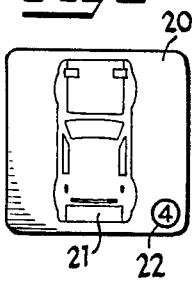
FIG. 5 is an enlarged scale, top plan view of a representative one of the item cards shown in FIG. 1.
Figure 6:
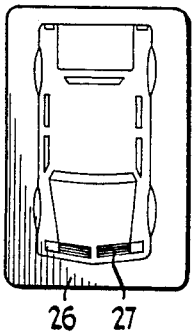
FIG. 6 is an enlarged scale, top plan view of a representative one of the other set of cards shown in FIG. 1.
Figure 8:
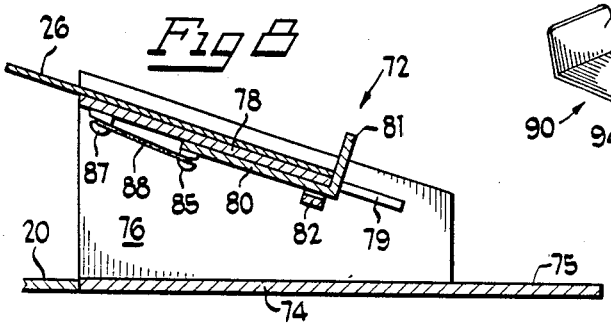
FIG. 8 is an enlarged scale, sectional view taken generally along line 8—8 of FIG. 7.

As is illustrated in FIG. 2, toy vehicle 25 is placed atop carriage 40 with the back end of the vehicle abutting tab 41. The player, grasping tab 41, pulls carriage 40 back and down against the bias of elastic band 48 until forward projection 42 abuts stops 36. Upon the player releasing the carriage it is propelled forwardly and upwardly along ramp 32 until it is stopped by the abutment of forward projection 42 against the front edge of slot 35, at which time the toy vehicle 25 jumping article continues in a jumping trajectory.

For better determination of whether a jump has been successfully completed a target landing ramp 50 is provided. Like launcher 30, the bottom periphery of landing ramp 50 is square and fits within square spaces 14 on the board. The bottom edges of a pair of spaced apart sidewalls 52 define the bottom periphery of the landing ramp. Extending between sidewalls 52 is a platform 54 that angles downwardly from the front receiving end to the back end. Also spanning the sidewalls is a back stop wall 55 that extends upwardly into an integral deflector portion 56 bent toward the front receiving end.

If a line of items fill all eight of the spaces along the length, or all four spaces across the width, of the board shown in FIG. 1, launcher 30 and target landing ramp 50 must be positioned in smaller, open sided, peripheral rectangular spaces 18 to attempt a jump. In order to better support launcher 30 and landing ramp 50 in such attempts, a pair of extensions 60 are provided. Each extension provides an open sided rectangular space 62 at a height substantially equal to that of playing surface 12, which when combined with one of the spaces 18 forms a square space equivalent to spaces 14. The two short sides and one of the long sides of the extension are provided with a raised rib or ridge 64, similar to raised ribs 16.

Figure 7:
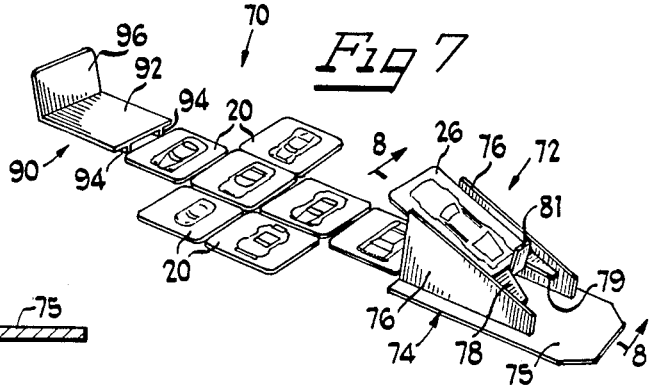
FIG. 7 is a perspective view of an alternative embodiment.

FIG. 7 shows an alternative game 70 embodying the present invention but which does not require a board. Game 70 instead may be played on any generally flat surface, such as may be provided by a table or even a floor. Accordingly, the items to be jumped such as cards 20 are laid directly in a domino-like manner on the table, floor or other convenient flat playing surface. FIG. 7 also illustrates the use of one of the cards 26 as the jumping article.

Game 70 uses a launching ramp 72 that is mechanically similar to launch ramp 30. Launcher 72 is mounted on a flat, rectangular bottom plate 74 that has a rearward, or player facing, extension 75. Atop the forward end of plate 74 are a pair of spaced apart sides 76. Between the sides and spaced above the bottom plate is a ramp 78 angled upwardly toward the forward end. A truncated "V" notch 79 is cut in from the rearward player facing end of the ramp. Mounted for sliding movement relative to the ramp is a carriage 80 with a tab 81 projecting upwardly adjacent the player facing end. Spanning between the sides, spaced below the ramp, is a rail 82 that supports the back end of carriage 80. At the front end of the carriage, a hook 85 depends from the underside. An opposed hook 87 depends from the underside of ramp 78 adjacent the forward or launching end. A rubber band 88 stretched between the hooks biases carriage 80 and tab 81 up toward the launch end.

When tab 81 is pulled back, a combination of the rearward movement of carriage 80 and the downward angle of ramp 78 keep jump card 26 substantially in contact with the tab. Rearward movement of the carriage is stopped by abutment of hook 85 against rail 82. Upon the player releasing the carriage, or more particularly, tab 81, elastic band 88 urges carriage 80 forward until the tab hits the truncated end of notch 79, at which time jump card 26 will continue forward in an item line jumping trajectory. Since launcher 72 is not restrained as launcher 30 is by ribs 16 on board 11, rearward extension 75 of the bottom plate provides a convenient place for the player to hold down launcher 72.

As in game 10, a target landing ramp 90 provides better determination of whether a jump has been successfully completed. Landing ramp 90 comprises a platform 92 that is, by means of angled underside runners 94, canted back downwardly from the end near the line of cards 20. At the far end, target landing ramp 90 has an upwardly extending stop wall 96.

The play of both of games 10 and 70 is substantially the same. Each player is initially given three of the item cards 20, the remainder of such cards forming a draw pile from which one is drawn and placed face up on the playing surface. When playing game 10, the initial card placement may be restricted to one of the four center squares. Players then proceed in turn to draw a card and select, from the combination of the drawn card and the cards already in the player's hand, a card to place in a free space adjacent one of the cards already up on the playing surface. The object of the card placement being to entrap a line of items between two identical end items.

Upon a player placing an item card at one end of a line of at least two other items that is of the same set as an item at the opposite end, the player qualifies to attempt to jump the line. Launcher 30 or 72 is then placed at the end of the line proximal the player and target ramp 50 or 90 is placed at the distal end and the article is launched. If the player is successful in completing the jump, the player collects all of the jumped cards which are then out of play. Play continues until the pile of item cards 20 is used up and no one can make a jump qualifying play. The points of the collected item cards are then tallied and the player with the most points wins.

In one variation of play, after a player entraps a line of items, but before the player attempts to jump, any other player able to add another item card of the same set as the end cards at either end of the line may take away the right to attempt the jump. Yet another variation involves the use of article cards 26, an equal number of which is distributed to each player at the beginning of the game. Upon missing a jump, a player having a card 26 could use it for another try. Jump cards 26 may be used in such a variation with a toy vehicle 25 being used as the actual jumping article.

While particulars embodiments of the present invention have been shown and described with some alternatives and variations, further changes and modifications will occur to those skilled in the art. It is intended in the appended claims to cover all such alternatives, variations, changes and modifications as fall within the true spirit and scope of the present invention.

What is claimed as new and desired to be secured by Letters Patent is:

1. A game comprising in combination:

a plurality of items divided by means distinguishing the items into two or more sets of two or more items each;

the items being alignable upon a playing surface to form a line extending from one end defined by one of the items to another end defined by another of the items;

an article, which is one of the items, capable of being launched from adjacent the one end to beyond the other end; and means for launching the article from adjacent the one end to beyond the other end.

2. The game of claim 1 including:

a landing ramp placeable adjacent the other end;

the landing ramp having a near end adjacent the other end of the line of items and a far end spaced from the near end; and the landing ramp having a generally upstanding back stop wall adjacent the far end.

3. The game of claim 1 in which:

the playing surface is provided by a board with a grid of spaces for placement of the items and launching means; and the board includes raised ribs forming the grid.

4. A game comprising in combination:

a plurality of items divided by means distinguishing the items into two or more sets of two or more items each;

the items being alignable upon a playing surface to form a line extending from one end defined by one of the items to another end defined by another of the items;

an article capable of being launched from adjacent the one end to beyond the other end;

means for launching the article from adjacent the one end to beyond the other end;

a landing ramp placeable adjacent the other end;

the landing ramp having a near end adjacent the other end of the line of items and a far end spaced from the near end; and the landing ramp having a generally upstanding back stop wall adjacent the far end.

5. The game of claim 4 in which the ramp is angled upwardly from the far end toward the near end.

6. The game of claim 4 in which the article is one of the items.

7. The game of claim 4 in which:

the playing surface is provided by a board with a grid of spaces for placement of the items and launching means; and the board includes raised ribs forming the grid.

8. A game comprising in combination:

a plurality of items divded by means distinguishing the items into two or more sets of two or more items each;

the items being alignable upon a playing surface to form a line extending from one end defined by one of the items to another end defined by another of the items;

an article capable of being launched from adjacent the one end to beyond the other end;

means for launching the article from adjacent the one end to beyond the other end;

the playing surface being provided by a board with a grid of spaces for placement of the items and launching means; and the board including raised ribs forming the grid.

9. The game of claim 8 in which the article is one of the items.

10. A method of playing a game comprising the steps of:

providing two or more players with a plurality of distinguishable items divided into two or more sets of two or more items each;

allocating some of the items to each player;

designating an order the players will follow with respect to each other;

each player in turn placing one of the player's allocated items on a playing surface generally in line, or transverse to, any item, or line of items, already on the playing surface;

placing an item at an end of a line of two or more items already on the playing surface that is of the same set as the item at the opposite end of the line; and attempting to launch an article over the line of items on the playing surface from a proximal end of the line to the distal end.

11. The method of claim 10 including the step of positioning a target ramp adjacent the distal end of the line.

12. The method of claim 10 including the step of giving the player attempting the jump the number of attempts equal to the number of items between the two end items.

13. The method of claim 10 including the steps of:

providing each player with more than one article or representation of the article; and according a player having an article or representation of the article a successive attempt.

14. The method of claim 10 including the step of an opposing player placing another item of the same set at either end of the line and attempting to launch the article over the line.

15. The method of claim 10 including the step of using one of the items as the article.

* * * * *